US005567073A

United States Patent [19]

de Laforcade et al.

[11] Patent Number: 5,567,073

[45] Date of Patent: Oct. 22, 1996

[54] APPLICATOR DEVICE FOR LIQUID

[75] Inventors: Vincent de Laforcade, Rambouillet; Fanny Guillaumat-Louvard, Levallois-Perret; Laurent Dubois, Paris, all of France

[73] Assignee: L'Oreal, Paris, France

[21] Appl. No.: 348,983

[22] Filed: Nov. 28, 1994

[30] Foreign Application Priority Data

Nov. 29, 1993 [FR] France ..... 93 14235

[51] Int. Cl.[6] ..... A45D 34/00; A45D 34/04

[52] U.S. Cl. ..... 401/190; 401/202

[58] Field of Search ..... 401/190, 202; 222/402.13

[56] References Cited

U.S. PATENT DOCUMENTS

| | | | |
|---|---|---|---|
| 3,173,167 | 3/1965 | Kaufman | 401/190 |
| 3,256,549 | 6/1966 | Evesque | 401/190 |
| 3,345,673 | 10/1967 | Schwartzman . | |
| 3,663,113 | 5/1972 | Frain et al. | 401/206 |
| 3,685,913 | 8/1972 | Pass | 401/190 |
| 3,792,802 | 2/1974 | Gores | 222/402.13 |
| 4,089,609 | 5/1978 | Gring et al. . | |
| 4,132,333 | 1/1979 | Debard | 222/402.13 |
| 4,277,004 | 7/1981 | Barlics | 222/402.13 X |
| 4,603,992 | 8/1986 | Kavoussi . | |
| 5,018,894 | 5/1991 | Goncalves . | |
| 5,073,057 | 12/1991 | Lathrop et al. | 401/202 X |
| 5,230,579 | 7/1993 | Klawson | 401/202 X |

FOREIGN PATENT DOCUMENTS

| | | | |
|---|---|---|---|
| 0037903 | 10/1981 | European Pat. Off. . | |
| 0374339 | 6/1990 | European Pat. Off. . | |
| 2647034 | 10/1990 | France . | |
| 2017009 | 10/1971 | Germany . | |
| 55773 | 3/1968 | Luxembourg . | |
| 466176 | 1/1969 | Switzerland . | |
| 2198035 | 6/1988 | United Kingdom | 401/190 |

*Primary Examiner*—Steven A. Bratlie
*Attorney, Agent, or Firm*—Staas & Halsey

[57] ABSTRACT

Applicator device for liquid, including a container and a dispenser head connected to the container via a dispenser cap. The dispenser head is made of a porous material. The container is a pressurized reservoir equipped with a dispenser valve. The dispenser head is borne by a support connected to a joining piece for cooperating with the valve to open the valve when a mechanical stress is exerted on the dispenser head. The liquid discharged from the reservoir during valve opening is channelled through the joining piece towards an inner face of the dispenser head. The dispenser cap includes a fastening member for connecting the cap to the reservoir. A flexible element connects the fastening member and the support, the rigid skirt being connected, in the vicinity of its upper edge, to a cylindrical wall which constitutes the flexible element. The dispenser cap is made in one piece by plastic molding.

24 Claims, 2 Drawing Sheets

APPLICATOR DEVICE FOR LIQUID

BACKGROUND OF THE INVENTION

1. Field of the Invention

The present invention relates to an applicator device for liquid and in particular to a device which can be used for local application, to the skin, of a product which has a cosmetic or dermopharmaceutical action, such as, for example, a deodorant.

2. Description of the Prior Art

In the specific case of products such as a deodorant or an antiperspirant, it has already been proposed to effect application by means of a solid stick containing the active ingredient to be applied to the skin of the user; such a stick can have, in cross-section, various shapes chosen as a function of the application, and it is packaged in a casing which permits displacement of the stick as the latter is used up. The disadvantage of such a presentation is, on the one hand, that the packaging of the product necessitates the use of special and expensive equipment, and, on the other hand, that in general the preservation of the stick is not completely guaranteed since the solid composition used contains a substantial percentage of alcohol and the packaging is in general not sufficiently impervious to prevent evaporation of the alcohol. In addition, the comfort of the user is not entirely satisfactory since, with the known compositions, the application of a stick to the skin gives the sensation of a greasy application, whereas the user wants an application which is not greasy and which has a refreshing effect.

It has already been proposed to overcome these disadvantages by providing an applicator which uses a liquid composition contained in a can on which is fixed a dispenser cap bearing a dispenser head made of a porous solid material. This type of embodiment has been described, for example, in the patent U.S. Pat. No. 5,230,579 or in the French patent FR-89-06490. The disadvantage of this type of packaging is twofold: on the one hand, in order to close the can when the product is not in use, it is necessary to provide a relatively complicated dispenser cap, which fact considerably increases the cost of the packaging; and, on the other hand, in order to use the product, it is necessary to carry out a preliminary maneuver bringing the liquid into the porous head with which the application will be effected: in the case of the two prior art patents mentioned above, this maneuver involves first turning the can upside down so that the liquid flows by gravity down into the porous head.

It has also been proposed to apply the products of this type in aerosol form, in which case the liquid composition dispensed is perfectly preserved during its storage since it is situated inside a pressurized container closed by a valve. However, this mode of application has considerable drawbacks: the application, even when it is well aimed, in fact generates a cloud of liquid particles which is partially inhaled by the user, often resulting in a particularly unpleasant sternutatory effect, especially when washing in the morning in the bathroom, or even more serious reactions in the case of asthma sufferers who are particularly sensitive to the inhalation of aerosol particles. In addition, dispensing by aerosol involves discharging into the atmosphere, at the same time as the liquid particles of the aerosol, the pressurizing gas; if pressurizing is effected by a non-liquefied compressed gas, for example by air, the dispensing pressure decreases as the reservoir empties, so that, at the end of dispensing, the particles of the aerosol are too heavy; if pressurizing is effected using a partially liquefied chlorofluoroalkane, atmospheric pollution is generated; finally, if pressurizing is effected using partially liquefied butane or propane, the product cannot in any way be considered hypoallergenic, given the risk of some users inhaling the propellant.

With the aim of eliminating the disadvantages mentioned hereinabove, an applicator device for liquid has been proposed, in accordance with EP-A-0 374 339, comprising a container for the liquid to be applied to a surface to be treated, and a dispenser head connected to the container via a dispenser cap, the dispenser head being made of a porous material adapted for application of the liquid by simple rubbing of the outer face of the head on the surface to be treated, the container being a pressurized reservoir equipped with a dispenser valve, the dispenser head being borne by a support which constitutes an element of the dispenser cap and is mechanically connected to a joining piece capable of cooperating with the valve so as to bring about its opening under the action of a mechanical stress exerted on the dispenser head, the liquid discharged from the reservoir during the opening being channelled through the joining piece towards that face of the dispenser head which is opposite the outer face of the head, the dispenser cap including a fastening member allowing the said cap to be connected to the reservoir, and the fastening member being a rigid skirt fixed on the reservoir by snap-fitting of a snap-fitting zone. Such a device has the advantage of not requiring to be turned upside down prior to application; however, it is not easy to use: on the one hand, the dispenser head is guided along the axis of the stem of the dispenser valve which it is necessary to activate along this axis in order to open it, while a transverse movement must be given to the device for spreading the product over the surface to be treated, and, on the other hand, this axial force for opening the valve is effected counter to the elastic means particular to the dispenser valve, and it is difficult to regulate or meter the dispensing of the product.

SUMMARY OF THE INVENTION

The object of the present invention is to propose an applicator device of the above type which eliminates all the disadvantages mentioned hereinabove and which can be produced at a reduced cost. The device according to the invention can be used for dispensing products which have a cosmetic or dermopharmaceutical action, but it is in no way limited to this type of application: it can be used in all cases where it is desired to spread a liquid over a surface by means of an applicator. In the case of local application to the skin of a user, the device according to the invention then has the advantage of not requiring to be turned upside down prior to application, which fact is of additional benefit to the user, particularly for applying deodorants or antiperspirants to the armpits.

In accordance with a first characteristic of the device according to the invention, a flexible element connects a fastening member and the support of a dispenser head.

In accordance with another characteristic of the device according to the invention, a rigid skirt is connected, in the vicinity of its upper edge, to a cylindrical wall which constitutes the flexible element.

In accordance with yet another characteristic of the device according to the invention, a dispenser cap is made in one piece by molding of plastic material.

Of course, the applicator device according to the invention can include at one and the same time the three characteristics mentioned hereinabove.

In a preferred embodiment, the support of the dispenser head is a dish exhibiting, over at least one zone, a depression capable of collecting an excess of liquid discharged via the valve.

In an advantageous design, the reservoir is a cylindrical can whose top is shaped as a nose cone and carries the dispenser valve, a snap-fitting groove being provided in the connection zone between the cylindrical wall and a nose cone wall, the rigid skirt being cylindrical and carrying, in the vicinity of one of its edges, a snap-fitting means capable of cooperating with the snap-fitting groove.

The flexible element preferably connects that zone of the rigid skirt furthest from the snap-fitting zone to the periphery of the support of the dispenser head; the rigid skirt and the flexible element can include a continuous wall surrounding the dispenser valve when the dispenser cap is snapped onto the reservoir; however, the flexible element could equally be provided in a discontinuous form by means of a plurality of successive sectors. With the exception of the fastening means of the dispenser head, the dispenser cap is advantageously a component with revolution about an axis.

The dispenser valve preferably includes a protruding stem which is inserted partially, in a sealed manner, into an internal channel of a joining piece; the joining piece can be arranged in the central zone of the support of the dispenser head, the joining piece having a cylindrical shape, along the axis of which its internal channel is formed.

In the case of an applicator device intended for applying a cosmetic or dermopharmaceutical product to the skin, the dispenser valve is advantageously one which opens by lateral tilting of its protruding stem.

The dispenser head can include a ceramic or plastic sinter material, especially a material obtained by compression of particles of plastic material; for example, it is possible to use a sinter obtained by compression of calibrated spherules of polyethylene, the sinter having a porosity of between 10 microns and 500 microns. The choice of porosity is generally made taking into consideration two parameters: on the one hand, the desired flow rate for the liquid to be applied, and, on the other hand, the surface finish of the porous head, which must be compatible with the intended surface to be treated. In order to define the porosity, the flow rate of a liquid through a given thickness of the sinter at a predetermined pressure difference is measured, in a known manner, and the equivalent section of a channel ensuring the same flow rate under the same conditions is deduced therefrom, and, consequently, the mean diameter of a pore when the number of pores per unit of surface area of the head is known statistically. When the dispenser head is formed from a plastic sinter, it can include synthetic resins such as high-density or low-density polyethylenes, polypropylenes or polyvinylfluorides, the preferred porosity range extending from 10 to 200 microns.

The dispenser head of the device according to the invention can equally be formed using an open-cell foam, for example a polyethylene foam; this foam can be covered with a fabric 15 for comfort of application.

The dispenser head advantageously includes a non-deformable material.

It should be noted that, in the case where a valve is used which opens by lateral tilting, the discharge of the liquid from the reservoir takes place as a result of the friction between the dispenser head, on the one hand, and the surface to be treated, on the other; the extent of the friction triggering the opening of the valve can be regulated by acting on the deformability of the flexible element which, in the dispenser cap, connects the rigid skirt and the support of the dispenser head. It should also be noted that, if the outer face of the dispenser head bears a liquid film, the friction force between the dispenser head and the surface to be treated will be low, which will make it possible to use up the liquid film before any subsequent opening of the dispenser valve. It will be possible to use a flexible element which can be easily deformed to a greater or lesser extent so that, during its functioning, the pressure with which the dispenser head bears on the surface to be treated will be that which is desirable for the intended application.

The application face of the dispenser head advantageously has a surface roughness which is such that the mean Ra of the roughness spacings is between 0.5 μm and 100 μm, preferably between 6 μm and 50 μm.

Another advantage of the device according to the invention lies in the fact that, when the valve opens, the liquid is discharged in the direction of the dispenser head by the pressurizing agent, but that since this does not involve dispensing by aerosol, the pressurizing agent can remain entirely inside the container: there is therefore no risk of atmospheric pollution and no loss of the possibly hypoallergenic nature of the liquid to be dispensed. In addition, the dispensing is carried out without generating any cloud of liquid particles which might be inhaled by the user, with a sternutatory effect.

It should also be noted that the pressure reduction of the liquid on leaving the pressurized reservoir provides, in the case of local application, a feeling of freshness which is particularly pleasant for the user.

Furthermore, the device according to the invention does not present any risk of leakage, given that the dead volumes below the dispenser head are greatly reduced; in the event of excessive instantaneous dispensing of liquid, the liquid collects in that zone of the dispenser head which occupies the depressions of the dish in which the dispenser head is positioned. It is possible for the user deliberately to dispense a greater quantity by pressing with a finger on the surface of the dispenser head before carrying out the application on the surface to be treated.

So that the subject of the invention will be better understood, an embodiment thereof, represented in the attached drawing, will now be described by way of a purely illustrative and non-limiting example.

DESCRIPTION OF THE PREFERRED EMBODIMENTS

Figure 1:
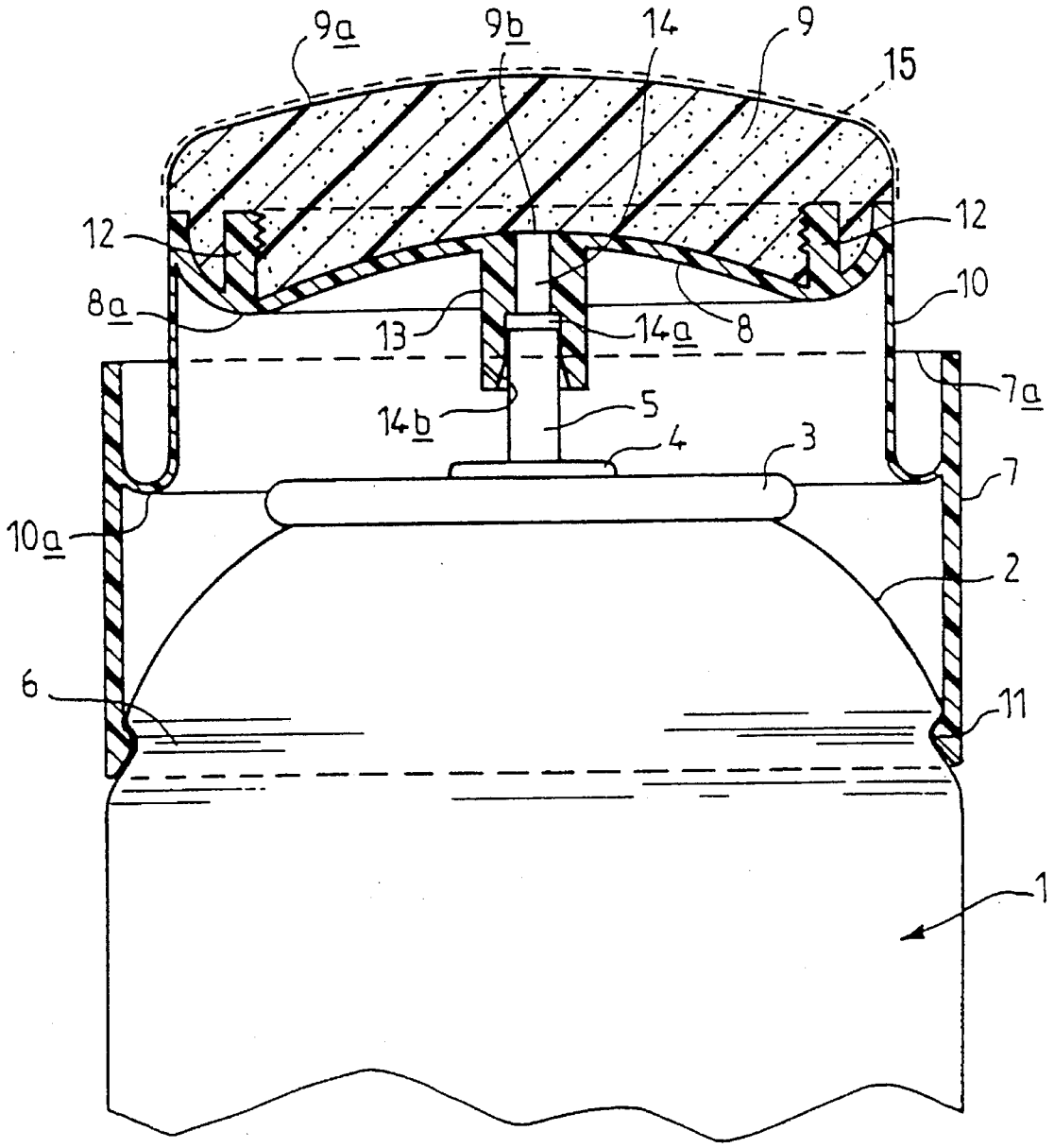
FIG. 1 represents, in axial section, an applicator device according to the invention.

Referring to the drawings, it will be seen that the pressurized reservoir of the device according to the invention has been designated by 1. This reservoir is a cylindrical can of circular cross-section, the top of which is shaped as a nose cone 2 and bears, in its upper part, a valve plate made integral with the can by means of a crimped flange 3. The valve plate bears, along its axis, a dispenser valve 4 which, in the case of this example, is a valve including a protruding stem 5; the valve 4 is opened by lateral tilting of the protruding stem 5; the valve can be of the type marketed by the company "COSTER" under the reference "TR 120-40". In a junction zone between the nose cone 2 and the cylindrical wall of the reservoir 1, a peripheral snap-fitting groove 6 has been formed.

A liquid to be dispensed has been stored under pressure in the reservoir 1. This liquid can be a body deodorant liquid composition having a viscosity of approximately 0.003 Pa. Pressurization can be effected either by bringing the liquid directly into contact with the propellant gas, or by separating the liquid and the propellant gas by a movable piston or by a deformable flexible bag, which, in this latter case, obviates the need to use the device in a determined position, with the valve upwards or with the valve downwards. In the example described, butane has been used as the propellant gas, the liquid being separated from the butane by a movable piston.

A dispenser cap has been fixed on the reservoir which has just been described, this dispenser cap including, on the one hand, a rigid skirt 7, and, on the other hand, a dish 8 which constitutes the support of a dispenser head 9, and, finally, a flexible element 10 which connects the dish 8 and the rigid skirt 7. The rigid skirt 7 includes on the inner side, at its base, an annular snap-fitting flange 11 which is intended to cooperate with the snap-fitting groove 6. The rigid skirt 7 is connected, in the vicinity of its upper edge 7*a*, to a cylindrical wall which constitutes the flexible element 10, the connection being made via a rounded zone 10*a* whose convexity is directed towards the snap-fitting flange 11. The rigid skirt 7 and the flexible element 10 have a general cylindrical shape and constitute coaxial cylinders. Along its edge which is opposite the zone 10*a*, the flexible element 10 is connected to the dish 8; the dish 8 includes an annular depression 8*a*, at the bottom of which there are projections 12 which constitute fastening means for the dispenser head 9. In its central zone, the dish 8 is made integral with a joining piece 13 of cylindrical shape, the joining piece including, along its axis, a channel 14 whose lower part 14*a* has a widened diameter, the lower part 14*a* opening outwards via a frustoconical orifice 14*b*. The free end of the protruding stem 5 of the valve 4 is engaged by force, over a distance of a few millimeters, into the part 14*a* of the channel 14 in order to obtain a sealed connection between the stem 5 and the joining piece 13.

The dispenser head 9, which preferably includes a polyethylene sinter having a porosity of 40 microns, has been placed inside the dish 8. The surface roughness of the dispenser head is such that the mean Ra of the roughness spacings is of the order of 15 μm; Ra is the arithmetic mean of the spacings of the real surface in relation to the median surface; this arithmetic mean Ra given by the formula:

$$Ra = \frac{1}{l_m} \int_0^{l_m} |f(x)| dx$$

in which f(x) is the measure of the distance from the real surface to the median surface at an abscissa point x over a length $l_m$, measured using a "SURFTEST 301" apparatus marketed by the company "MITUTOYO".

To use the device described hereinabove, the user applies the outer face 9*a* of the head 9 against the surface to be treated, for example the skin of an armpit if the liquid stored in the reservoir 1 is a deodorant liquid. He then moves the device sideways with respect to the armpit, resulting in a frictional force which causes the deformation of the flexible element 10 and, consequently, a substantially radial displacement of the dish 8 with respect to the reservoir 1 and thus with respect to the axis of the valve 4. This results in a lateral tilting of the protruding stem 5 and, consequently, an opening of the valve 4 with simultaneous discharge of the liquid stored under pressure in the reservoir 1. The liquid arrives on the inner face 9*b* of the dispenser head 9; it spreads over the whole of this inner face and, under the effect of the dispensing pressure, it passes through the sinter constituting the dispenser head 9 and comes to lie on the outer face 9*a* of the head. The liquid is then dispensed by friction on the surface to be treated, for instance the skin of the armpit; if there is an excess of liquid, the frictional force diminishes, which results in the closure of the valve 4 under the effect of the elastic return which exists inside the valve.

Figure 2:
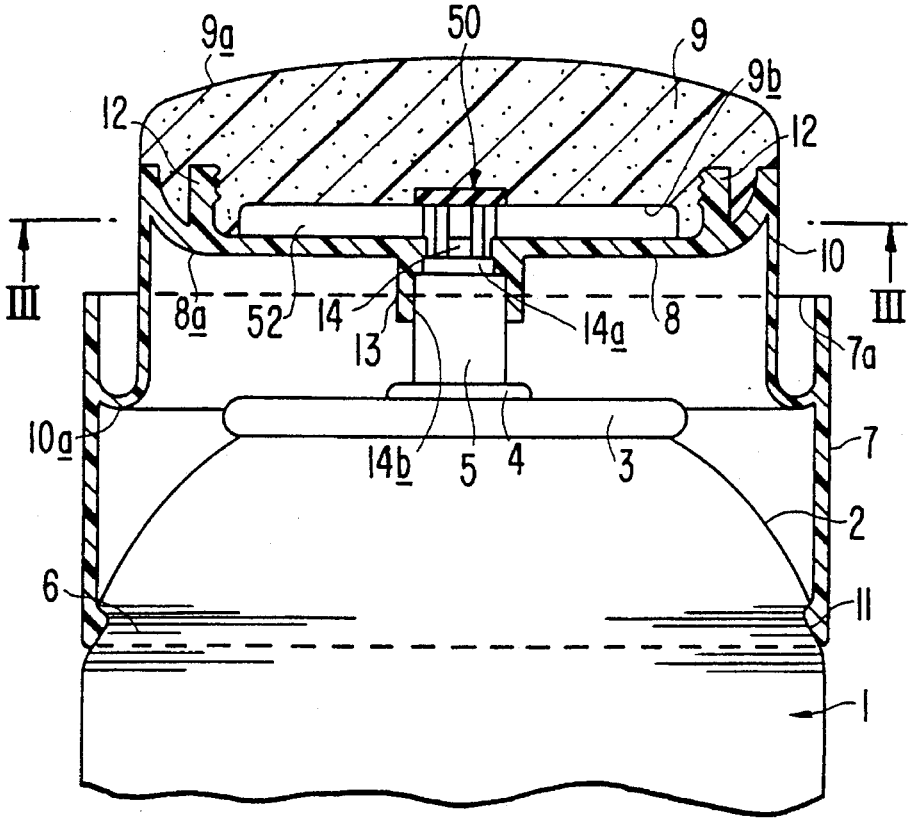
FIG. 2 represents, in axial section, an applicator device according to an alternate embodiment of the invention.
Figure 3:
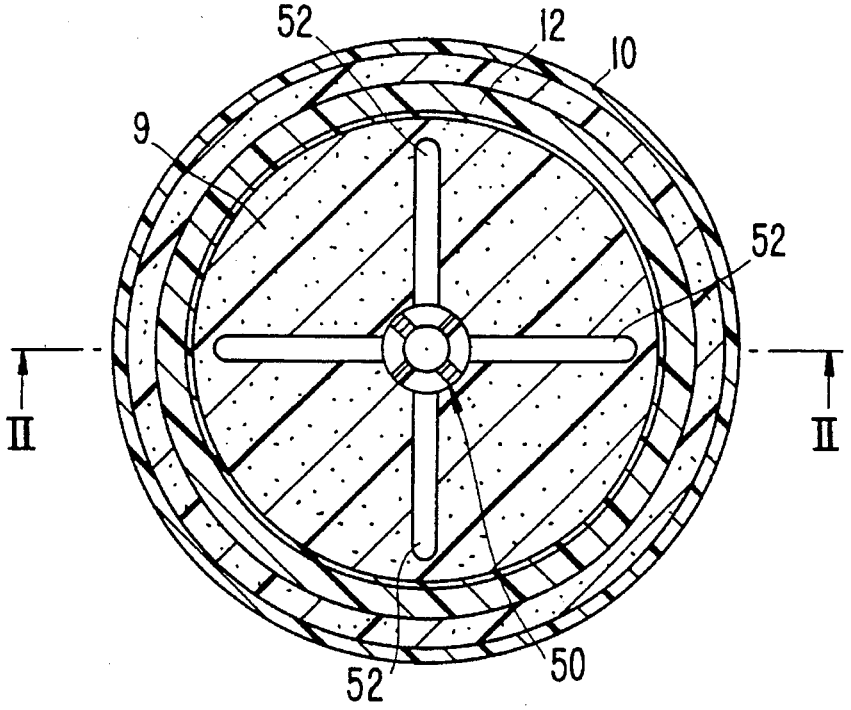
FIG. 3 is a cross-section along lines III—III of FIG. 2.

As shown in FIG. 2, it is possible to arrange substantially radial channels 52 between the inner face of the support 8 and the inner face 9*b* of the dispenser head 9, it being possible for the channels 52 to be formed in the dispenser head 9 itself and/or in the wall of the support 8: the advantage of these channels 52 is that they ensure a good distribution of the liquid to be dispensed, so that the outer face 9*a* of the dispenser head 9 is supplied uniformly with the liquid. In addition, it is also possible to arrange, opposite the orifice 14*b* end of the internal channel 14 of the joining piece 13, an obstacle or jet break 50 which has the same purpose as that indicated hereinabove for the substantially radial channels 52 which may be provided.

It will be noted that the device which has just been described has a greatly reduced cost since the dispenser cap assembly including the skirt 7, the flexible element 10 and the dish 8 can be made in one piece by molding of plastic material. The use of this device is particularly reliable, given that there can be no leaking. Finally, the sensation obtained when using this device for local application is very agreeable because the user experiences a smooth and non-greasy application which has a refreshing effect, and the application can be carried out directly without first turning the device upside down.

We claim:

1. Applicator device for liquid to be applied to a surface to be treated, comprising:

(a) a container for the liquid, the container being a pressurized reservoir equipped with a dispenser valve;

(b) a head operatively connected to the container, the head being made of a porous material for applying the liquid by rubbing an outer face of the head on the surface to be treated;

wherein the porous material is a sintered body; and (c) a one piece cap for operatively connecting the head to the container, the cap including;

(1) a support for the head, (2) a joining piece connected to the support and including a channel for cooperating with the valve to cause the valve to open and discharge liquid, when a mechanical stress is exerted on the head in any direction, wherein the liquid discharged from the valve passes through the channel of the joining piece towards an inner face of the head which is opposite the outer face of the head, (3) a rigid coupling member for connecting the head to the container, the coupling member including a skirt and a fastening member to connect the cap to a connection zone on the container, and (4) a flexible element extending between the rigid coupling member and the support, allowing the head and the support with the joining piece to move relative to the coupling member and cause the valve to open, when the mechanical stress is exerted on the head.

2. Device according to claim 1, wherein the flexible element includes a cylindrical wall connecting an upper edge of the skirt to the support, and wherein the cap is made one piece by plastic molding.

3. Device according to claim 1, wherein the flexible element includes a rounded zone having a convexity directed towards the connection zone.

4. Device according to claims 1 or 2, wherein the support is a dish that collects an excess of liquid discharged via the valve.

5. Device according to claim 1, wherein the support comprises at least one fastener for holding the head on the support.

6. Device according to claims 1 or 2, wherein an obstacle is disposed at an end of the channel adjacent the inner face of the head to promote distribution of the liquid to the head.

7. Device according to claims 1 or 2, wherein substantially radial channels are formed in one of the inner face of the head and a surface of the support facing the inner face of the head to promote distribution of the liquid to the head.

8. Device according to claims 1 or 2, wherein the container is a cylindrical wall can having a top shaped as a nose cone and carrying the dispenser valve, the connection zone including a groove between the cylindrical wall and the nose cone to receive the fastening member, and the skirt being cylindrical and having, in the vicinity of a lower edge thereof, the fastening member which is a snap-fitting member for cooperating with the groove.

9. Device according to claims 1 or 2 wherein the flexible element connects an area of the skirt furthest from the fastening member to a periphery of the support.

10. Device according to claim 9, wherein the skirt and the flexible element form a continuous wall surrounding the valve, when the cap is on the container.

11. Device according to claims 1 or 2, wherein the valve comprises a protruding stem which is inserted partially, in a sealed manner, into the channel of the joining piece.

12. Device according to claim 11, wherein the joining piece is arranged in a central zone of the support and has a cylindrical shape, along the axis of which the channel is formed.

13. Device according to claim 11, wherein the valve opens by lateral tilting of the protruding stem.

14. Device according to claims 1 or 2, wherein the cap is rotatable about an axis of the valve.

15. Device according to claims 1 or 2, wherein the liquid is one of a cosmetic and dermopharmaceutical liquid applied locally on the skin of a user.

16. Device according to claim 15, wherein the liquid is a deodorant.

17. Device according to claim 1, wherein the sintered body comprises compressed particles of plastic material.

18. Device according to claims 1 or 2, wherein the sintered body has a porosity between 10 microns and 500 microns.

19. Device according to claim 18, wherein the sintered body has a porosity between 10 microns and 200 microns.

20. Device according to claims 1 or 2, wherein the head is non-deformable.

21. Device according to claims 1 or 2, wherein the outer face of the head has a surface roughness where the mean Ra of the roughness spacings is between 0.5 μm and 100 μm.

22. Device according to claim 21, wherein the Ra is between 6 μm and 50 μm.

23. Device according to claims 1 or 2, wherein the head comprises an open cell foam.

24. Device according to claim 23, wherein the open cell foam is covered by a fabric.

* * * * *